US008690550B2

(12) United States Patent
Wang et al.

(10) Patent No.: US 8,690,550 B2
(45) Date of Patent: Apr. 8, 2014

(54) MEMBRANE MICROPUMP

(75) Inventors: An-Bang Wang, Taipei (TW); Ming-Che Hsieh, Taipei (TW); I-Chun Lin, Taipei (TW); Wen-Huei Tsai, Taipei (TW)

(73) Assignee: National Taiwan University, Taipei (TW)

( * ) Notice: Subject to any disclaimer, the term of this patent is extended or adjusted under 35 U.S.C. 154(b) by 496 days.

(21) Appl. No.: 12/787,306

(22) Filed: May 25, 2010

(65) Prior Publication Data

US 2011/0158832 A1 Jun. 30, 2011

(30) Foreign Application Priority Data

Dec. 30, 2009 (TW) ..... 98145746 A

(51) Int. Cl.
*F04B 17/00* (2006.01)

(52) U.S. Cl.
USPC ..... 417/413.1

(58) Field of Classification Search
USPC ..... 417/322, 392–395, 412, 413.1, 413.2, 417/413.3; 137/808, 809
See application file for complete search history.

(56) References Cited

U.S. PATENT DOCUMENTS

| | | | | |
|---|---|---|---|---|
| 4,808,084 | A * | 2/1989 | Tsubouchi et al. | 417/322 |
| 5,303,275 | A * | 4/1994 | Kobsa | 376/352 |
| 6,203,291 | B1 | 3/2001 | Stemme et al. | |
| 6,261,066 | B1 | 7/2001 | Linnemann et al. | |
| 6,770,183 | B1 | 8/2004 | Hencken et al. | |
| 6,874,999 | B2 | 4/2005 | Dai et al. | |
| 6,932,580 | B2 | 8/2005 | Yagoobi et al. | |
| 7,431,432 | B2 * | 10/2008 | Worsman et al. | 347/61 |
| 2006/0204381 | A1 * | 9/2006 | Higashino et al. | 417/413.3 |

* cited by examiner

*Primary Examiner* — Peter J Bertheaud
*Assistant Examiner* — Dnyanesh Kasture

(57) ABSTRACT

A membrane micropump includes a vibration chamber, at least one flow guide, at least one fluid inlet, at least one fluid outlet, at least one inlet rectifier, at least one outlet rectifier, a vibration membrane and an actuator. The vibration chamber includes at least one chamber inlet and at least one chamber outlet. The flow guide can be connected to the chamber inlet, the vibration chamber, the chamber outlet or in the vibration chamber, or it can have more pairs to enhance the effects. The inlet rectifier connects the chamber inlet to the fluid inlet. The outlet rectifier connects the chamber outlet to the fluid outlet. The vibration membrane is disposed on the vibration chamber. The actuator is connected to the vibration membrane to reciprocate the vibration membrane, enabling fluid to flow into the vibration chamber via the fluid inlet and flow out thereof via the fluid outlet.

18 Claims, 10 Drawing Sheets

MEMBRANE MICROPUMP

CROSS REFERENCE TO RELATED APPLICATIONS

This Application claims priority of Taiwan Patent Application No. 098145746, filed on Dec. 30, 2009, the entirety of which is incorporated by reference herein.

BACKGROUND OF THE INVENTION

1. Field of the Invention

The invention relates to a membrane micropump, and in particular, to a membrane micropump which comprises a vibration chamber with flow guide.

2. Description of the Related Art

There are varieties of micropumps, and they are substantially distinguished into mechanical types and non-mechanical types. The mechanical micropump, is not limited by specific work fluid, and it can be designed differently according to different types of actuators and valves. The non-mechanical micropump is limited by the specific work fluid. For example, electrophoretic micropumps (U.S. Pat. No. 6,932,580) and electroosmosis micropumps (U.S. Pat. No. 6,770,183) can only used to pump work fluid with an electric charge or with polar molecules. Additionally, the non-mechanical micropump comprises relatively slow flow velocity and requires relatively high work voltage to operate.

The mechanical micropump comprises mostly membrane-displacement pumps (membrane pump in short) such as U.S. Pat. No. 6,261,066, which is also one of the main-stream research areas in mechanical micropump technology. Within the membrane micropump in the sub-component of the actuator, the piezoelectric actuator becomes the main issue of study. In another aspect, in the classification of the valve, the membrane micropump is distinguished into a valve type (U.S. Pat. No. 6,874,999) and a valveless type (U.S. Pat. No. 6,203,291). The valveless membrane micropump comprises a simple structure, non-moving parts and requires no extra energy consumption. Furthermore it does not become exhausted and clogged; therefore, it has recently become the main topic of study in this academic field.

However, all types of conventional valveless membrane micropump are focused on the design of the rectifier, not on the interior structure of the vibration chamber. Here, the vibration chamber is the main developing portion of the entire valveless membrane micropump, and the interaction of the vortices exists within the vibration chamber. In detail, the development of the vortices comprises characteristics highly related to the efficiency of the membrane micropump. As described, because the conventional membrane micropump is not designed according to the development of the vortice, there must be a lot of potential to improve the efficiency of the membrane micropump.

BRIEF SUMMARY OF THE INVENTION

Accordingly, the invention provides a membrane mircopump which is designed according to the development of the vortices to guide the fluid within the chamber to flow, and to reduce flow rate of the fluid toward the chamber inlet or increase flow rate of the fluid toward the fluid outlet in order to provide a positive net flow rate toward the fluid outlet. Prior technology can be incorporated which consists of applying a directionally-discrepant rectifier on the exterior of the vibration chamber; such as an active valve, passive valve or a valve-less valve, to increase the efficiency of the pump.

The present invention utilizes the characteristics described below to solve the above problem.

A first embodiment of the invention provides a membrane micropump comprising a vibration chamber, two flow guides, a fluid inlet, a fluid outlet, an inlet rectifier, an outlet rectifier, a vibration membrane and an actuator. The vibration chamber includes a chamber inlet and a chamber outlet. The two flow guides are symmetrically disposed at the chamber inlet and located near the chamber inlet to reduce the flow rate of the fluid toward the fluid inlet in order to provide a positive net flow rate toward the fluid outlet. The inlet rectifier connects the chamber inlet to the fluid inlet. The outlet rectifier connects the chamber outlet to the fluid outlet. When the flow resistance of the inlet rectifier and the flow resistance of the outlet rectifier are directionally-discrepant, the directionality of the membrane micropump is enhanced, and the efficiency of the membrane micropump is increased. The vibration membrane is disposed on the vibration chamber. The actuator is connected to the vibration membrane to reciprocate the vibration membrane, enabling the fluid to flow into the vibration chamber via the fluid inlet and flow out thereof via the fluid outlet.

A second embodiment of the invention provides a membrane micropump comprising a vibration chamber, two first flow guides, two second flow guides, a fluid inlet, a fluid outlet, an inlet rectifier, an outlet rectifier, a vibration membrane and an actuator. The vibration chamber includes a chamber inlet and a chamber outlet. The first two flow guides are symmetrically disposed at the chamber inlet and located near the chamber inlet. The second flow guides are symmetrically disposed at the chamber outlet and formed as a portion of a side wall of the vibration chamber to increase flow rate of the fluid toward the flow outlet or to reduce the flow rate of the fluid toward the fluid inlet in order to provide a positive net flow rate toward the fluid outlet. The inlet rectifier connects the chamber inlet to the fluid inlet. The outlet rectifier connects the chamber outlet to the fluid outlet. When the flow resistance of the inlet rectifier and the flow resistance of the outlet rectifier are directionally-discrepant, the directionality of the membrane micropump is enhanced, and the efficiency of the membrane micropump is increased. The vibration membrane is disposed on the vibration chamber. The actuator is connected to the vibration membrane to reciprocate for the vibration membrane which thus enables the fluid to flow into the vibration chamber via the fluid inlet and flow out thereof via the fluid outlet.

A third embodiment of the invention provides a membrane micropump comprising a vibration chamber, two first flow guides, two second flow guides, a fluid inlet, a fluid outlet, an inlet rectifier, an outlet rectifier, a vibration membrane and an actuator. The vibration chamber includes a chamber inlet and a chamber outlet. The two first flow guides are symmetrically disposed at the chamber inlet and located near the chamber inlet. The second flow guides, independent from the vibration chamber, are disposed in the vibration chamber and symmetrically disposed at the chamber outlet to increase flow rate of the fluid toward the flow outlet or to reduce the flow rate of the fluid toward the fluid inlet in order to provide a positive net flow rate toward the fluid outlet. The inlet rectifier connects the chamber inlet to the fluid inlet. The outlet rectifier connects the chamber outlet to the fluid outlet. When the flow resistance of the inlet rectifier and the flow resistance of the outlet rectifier are directionally-discrepant, the directionality of the membrane micropump is enhanced, and the efficiency of the membrane micropump is increased. The vibration membrane is disposed on the vibration chamber. The actuator is connected to the vibration membrane to reciprocate the vibration membrane, enabling the fluid to flow into the vibration chamber via the fluid inlet and flow out thereof via the fluid outlet.

A fourth embodiment of the invention provides a membrane micropump comprising a vibration chamber, four first flow guides, two second flow guides, two fluid inlets, a fluid outlet, two inlet rectifiers, an outlet rectifier, a vibration membrane and an actuator. The vibration chamber includes two chamber inlets and a chamber outlet. Each two of the first flow guides are symmetrically disposed at a chamber inlet and located near the chamber inlet. The second flow guides, independent from the vibration chamber, are disposed in the vibration chamber and symmetrically disposed at the chamber outlet to increase flow rate of the fluid toward the flow outlet or to reduce the flow rate of the fluid toward the fluid inlet in order to provide a positive net flow rate toward the fluid outlet. The two inlet rectifiers connect the chamber inlet to the fluid inlet. The outlet rectifier connects the chamber outlet to the fluid outlet. When the flow resistance of the inlet rectifiers and the flow resistance of the outlet rectifiers are directionally-discrepant, the directionality of the membrane micropump is enhanced, and the efficiency of the membrane micropump is increased. The vibration membrane is disposed on the vibration chamber. The actuator is connected to the vibration membrane to reciprocate the vibration membrane, enabling the fluid to flow into the vibration chamber via the fluid inlet and flow out thereof via the fluid outlet.

A fifth embodiment of the invention provides a membrane micropump comprising a vibration chamber, two first flow guides, two second flow guides, two third flow guides, a fluid inlet, a fluid outlet, a inlet rectifier, an outlet rectifier, a vibration membrane and an actuator. The vibration chamber includes a chamber inlet and a chamber outlet. The first flow guides are symmetrically disposed at the chamber inlet and located near the chamber inlet. The second flow guides are symmetrically disposed at the chamber outlet and formed as a portion of a side wall of the vibration chamber. The third flow guides, independent from the vibration chamber, are disposed in the vibration chamber and symmetrically disposed at the chamber outlet to increase flow rate of the fluid toward the flow outlet or to reduce the flow rate of the fluid toward the fluid inlet in order to provide a positive net flow rate toward the fluid outlet. The inlet rectifier connects the chamber inlet to the fluid inlet. The outlet rectifier connects the chamber outlet to the fluid outlet. When the flow resistance of the inlet rectifier and the flow resistance of the outlet rectifier are directionally-discrepant, the directionality of the membrane micropump is enhanced, and the efficiency of the membrane micropump is increased. The vibration membrane is disposed on the vibration chamber. The actuator is connected to the vibration membrane to reciprocate the vibration membrane, enabling the fluid to flow into the vibration chamber via the fluid inlet and flow out thereof via the fluid outlet.

According to the first, second, third, fourth and fifth embodiments of the invention, the actuator comprises a piezoelectric member, a electromagnetic driver, a heat driver, a pneumatic membrane member, a mechanical vibrating member or a thermal-pneumatic driver.

According to the first, second, third, fourth and fifth embodiments of the invention, an angle formed between a central line of the inlet rectifier and a normal line of a wall of the vibration chamber is between ±90°.

According to the first, second, third, fourth and fifth embodiments of the invention, an angle formed between a central line of the outlet rectifier and a normal line of a wall of the vibration chamber is between ±90°.

According to the first, second, third, fourth and fifth embodiments of the invention, an angle formed between a central line of the inlet rectifier and a central line of the outlet rectifier is between 0°~180°.

According to the first, second, third, fourth and fifth embodiments of the invention, the inlet rectifier's flow resistance and the outlet rectifier's flow resistance are directionally-discrepant to enhance the flow directionality of the membrane micropump and to increase efficiency of the membrane micropump. Otherwise, an angle formed between every central line of the outlet rectifier and a central line of the inlet rectifier is different, which may increase the functionality of the membrane micropump.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

First Embodiment

Figure 1A:
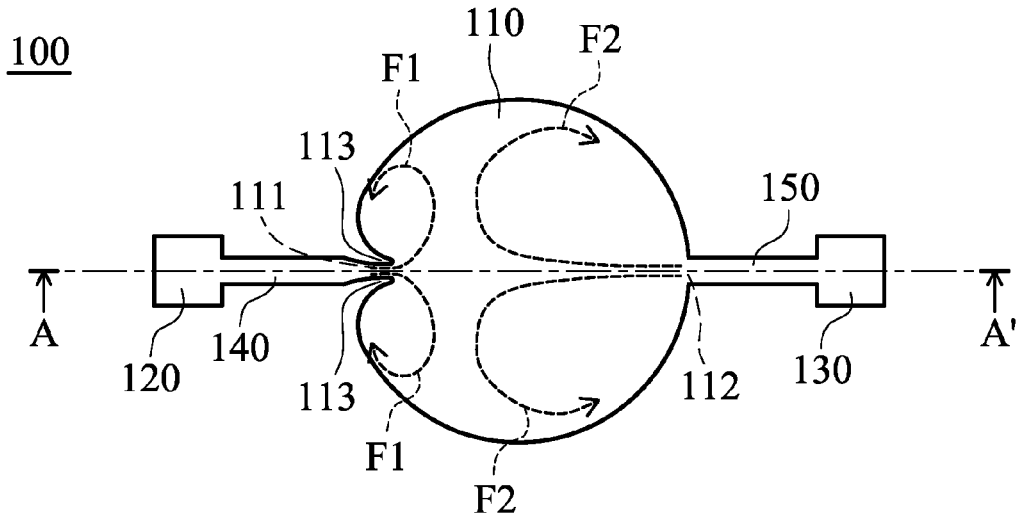
FIG. 1A is a top view of a membrane micropump of a first embodiment of the invention.
Figure 1B:
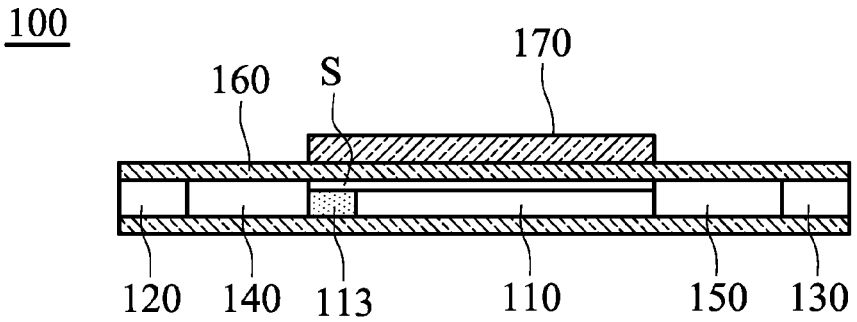
FIG. 1B is a sectional view cut along line A-A' in FIG. 1A.

Referring to FIGS. 1A and 1B, the membrane micropump 100 of the embodiment comprises a vibration chamber 110, two flow guides 113, a fluid inlet 120, a fluid outlet 130, an inlet rectifier 140, an outlet rectifier 150, a vibration membrane 160 and an actuator 170.

Figure 1C:
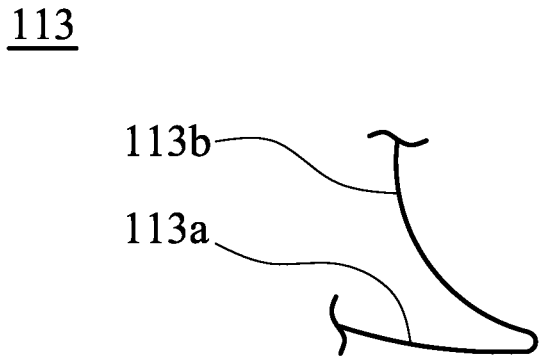
FIG. 1C is a schematic view of a flow guide in FIG. 1A.

The vibration chamber 110 comprises a chamber inlet 111 and a chamber outlet 112. The two flow guides 113 are symmetrically located at the chamber inlet 111 and near the chamber inlet 111. In detail, each flow guide 113, as shown in FIG. 1C, respectively comprises a inwardly-converging flange 113*a* and a curved structure 113*b*, wherein the inwardly-converging flange 113*a* connects with the chamber inlet 111 and extends toward the interior of the vibration chamber 110 to guide fluid into the vibration chamber 110. An end section of the curved structure 113*b* connects with the inwardly-converging flange 113*a* and extends toward the interior of the vibration chamber 110, and another end section thereof connects with a side wall of the vibration chamber 110. Thereby, the flow guide 113 is formed by the inwardly-converging flange 113*a* and the curved structure 113*b* which allows the reduction the flow rate of the fluid from the vibration chamber 110 back to the chamber inlet 111.

The vibration membrane 160 is disposed above the vibration chamber 110. Here shown in FIG. 1B, a membrane movement space S exists between the vibration membrane 160 and the vibration chamber 110.

The actuator 170 connects with the vibration membrane 160 and reciprocates the vibration membrane 160. The actuator 170 comprises a piezoelectric member, a electromagnetic driver, a heat driver, a pneumatic membrane member, a mechanical vibrating member or a thermal-pneumatic driver. For example, when the actuator 170 is a piezoelectric member, the vibration membrane 160 is deformed by reciprocally expansion and contraction of the piezoelectric member, enabling the vibration membrane 160 to reciprocally vibrate.

As described, when the actuator 170 drives the vibration membrane 160 to reciprocally vibrate, the interior space or volume of the vibration chamber 110 increases or decreases accordingly. In detail, when the vibration membrane 160 move upward (supply mode), the pressure in the vibration chamber 110 is lower than the pressure outside of the vibration chamber 110, enabling the fluid to flow from the fluid inlet 120 and the fluid outlet 130 to be sucked into the vibration chamber 110. On the contrary, when the vibration membrane 160 moves downward (pump mode), the pressure in the vibration chamber 110 is higher than the pressure outside of the vibration chamber 110, enabling the fluid to flow out of the vibration chamber 110 via the fluid inlet 120 and the fluid outlet 130. It should be noted that when the actuator 170 reciprocates, a pair of fluid vortices F1 and a pair of fluid vortices F2 respectively exist at the chamber inlet 111 and the chamber outlet 112 of the vibration chamber 110, which may be inspected via flow visualization technology, as shown in FIG. 1A. As described, by the disposition of the flow guide 113 near the chamber inlet 111, the amount of fluid near the chamber inlet 111 flowing back to the fluid inlet 120 is reduced when the actuator 170 reciprocates in order to provide a positive net flow rate toward the fluid outlet 130 and achieve operational function of the membrane micropump 100.

The inlet rectifier 140 connects the chamber inlet 111 with the chamber inlet 120 of the vibration chamber 110, which is utilized to merge and buffer the fluid reciprocating between the fluid inlet 120 and the vibration chamber 110.

The outlet rectifier 150 connects the chamber outlet 112 with the fluid outlet 130, which is utilized to merge and buffer the fluid reciprocating between the vibration chamber 110 and the fluid outlet 130.

Figure 1D:
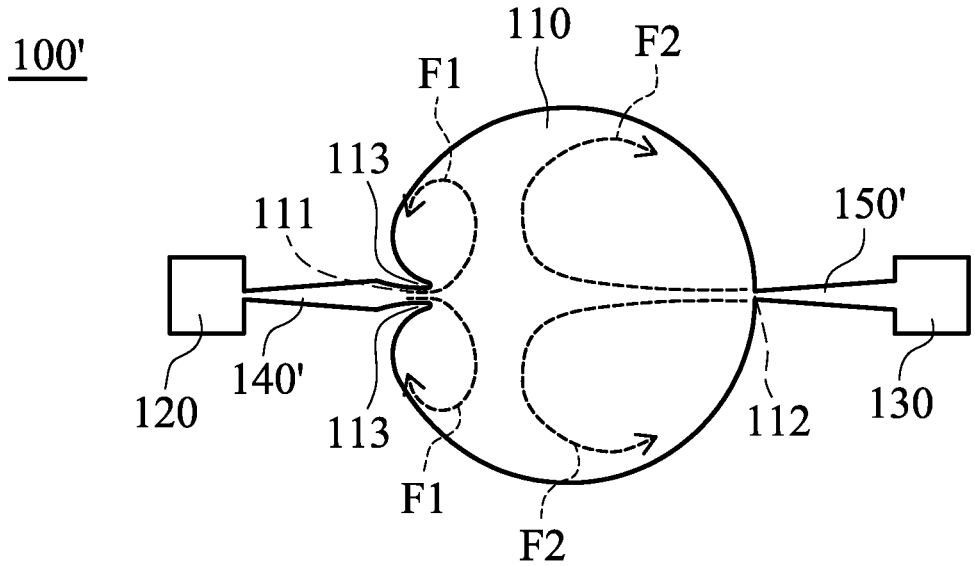
FIG. 1D is a schematic view of a variant embodiment of the membrane micropump in FIG. 1A.

As shown in FIG. 1D, the inlet rectifier and the outlet rectifier can change its geometric shape to enable the flow resistance to becoming directionally-discrepant in order to increase the efficiency of the membrane micropump. In detail, in the membrane micropump 100' as shown in FIG. 1D, the inlet rectifier 140' comprises a shape which ascends from the fluid inlet 120 toward the chamber inlet 111, and the outlet rectifier 150' comprises a shape which ascends from the chamber outlet 112 toward the fluid outlet 130. When the vibration membrane 160 moves upward (supply mode), the flow resistance of the fluid from the inlet rectifier 140' toward the vibration chamber 110 is lower than the flow resistance of the fluid from the outlet rectifier 150' toward the vibration chamber 110. On the contrary, when the vibration membrane 160 moves downward (pump mode), the flow resistance of the fluid from the outlet rectifier 150' toward the vibration chamber 110 is lower the flow resistance of the fluid from the inlet rectifier 140' toward the vibration chamber 110. Therefore, the efficiency of the membrane micropump 100' is enhanced. Moreover, the inlet rectifier and the outlet rectifier of the embodiment can be applied to a Tesla valve or other means (a structure or a process) to obtain discrepant flow resistances, and for example a surface wettability modification may apply.

Second Embodiment

Figure 2A:
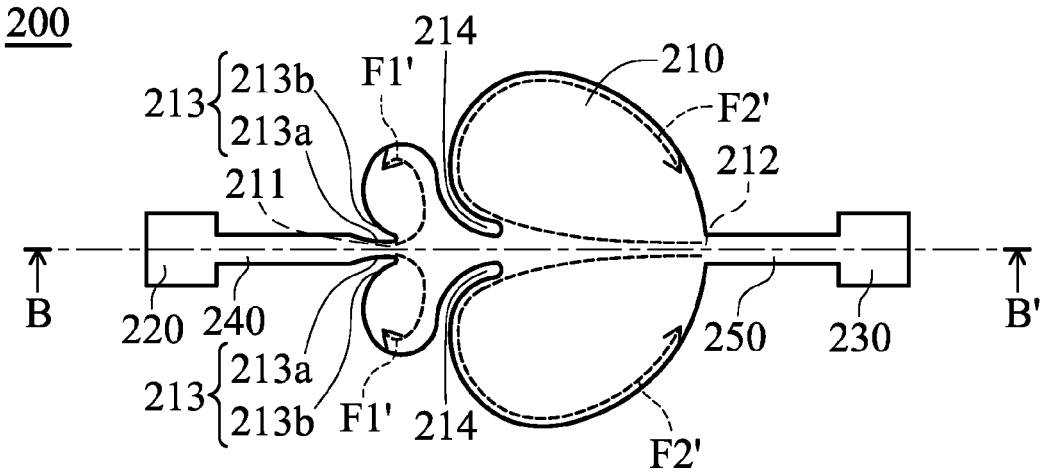
FIG. 2A is the top of a membrane micropump of a second embodiment of the invention.
Figure 2B:
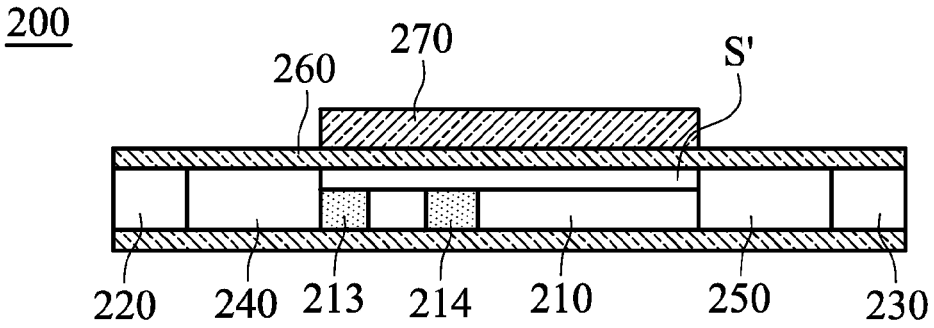
FIG. 2B is a sectional view cut along line B-B' in FIG. 2A.

Referring to FIGS. 2A and 2B, the membrane micropump 200 of the embodiment comprises a vibration chamber 210, two first flow guides 213, two second flow guides 214, a fluid inlet 220, a fluid outlet 230, an inlet rectifier 240, an outlet rectifier 250, a vibration membrane 260 and an actuator 270.

Figure 2C:
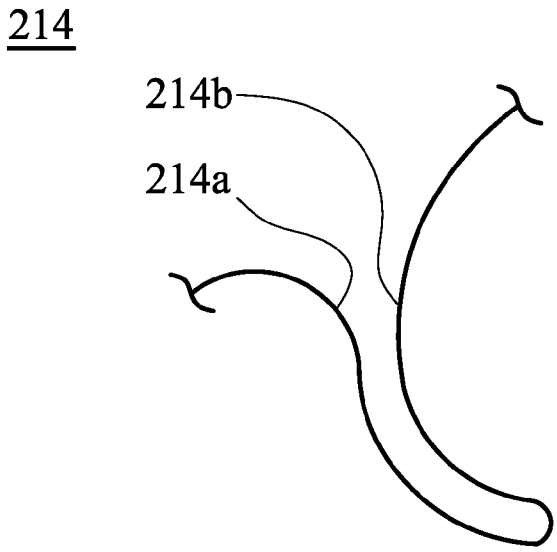
FIG. 2C is a schematic view of a second flow guide in FIG. 2A.

The vibration chamber 210 comprises a chamber inlet 211 and a chamber outlet 212. The two first flow guides 213 are symmetrically disposed at the chamber inlet 211 and located near the chamber inlet 211. The two second flow guides 214 guide the fluid smoothly toward the chamber outlet 212 and are disposed between the chamber inlet 211 and the chamber outlet 212. In detail, each of the first flow guide 213 respectively comprises a inwardly-converging flange 213*a* and a curved structure 213*b*, thereby to reduce the flow rate of the fluid from the vibration chamber 210 back to the chamber inlet 211. Each of the second flow guides 214 connects with the vibration chamber 210. In detail, each of the second flow guides 214 is formed as a portion of a side wall of the vibration chamber 210 and is integrally formed with the vibration chamber 210. As shown in FIG. 2C, each of the second flow guides 214 respectively comprises a first curved structure 214*a* and a second curved structure 214*b* in order to form a protruded structure extending toward the interior of the vibration chamber 210. The first curved structure 214*a* extends toward the chamber inlet 211, and the second curved structure 214*b* extends toward the chamber outlet 212 in order to guide the fluid smoothly to the chamber outlet 212. Thus, the operational function of the membrane micropump 200 is achieved. The vibration membrane 260 is disposed above the vibration chamber 210. Here shown in FIG. 2B, a membrane movement space S' exists between the vibration membrane 260 and the vibration chamber 210.

As shown in FIGS. 2A and 2B, the actuator 270, connected with the vibration membrane 260, is utilized to reciprocate the vibration membrane 260. The actuator 270 comprises a piezoelectric member, an electromagnetic driver, a heat driver, a pneumatic membrane member, a mechanical vibrating member or a thermal-pneumatic driver. For example, when the actuator 270 is a piezoelectric member, the vibration membrane 260 is deformed by reciprocally expansion and contraction of the piezoelectric member, enabling the vibration membrane 260 to reciprocally vibrate.

As described, when the actuator 270 drives the vibration membrane 260 to reciprocally vibrate, the interior space or volume of the vibration chamber 210 increases or decreases accordingly. In detail, when the vibration membrane 260 moves upward (supply mode), the pressure in the vibration chamber 210 is lower than the pressure outside of the vibration chamber 210, enabling the fluid to flow from the fluid inlet 220 and the fluid outlet 230 to be sucked into the vibration chamber 210. On the contrary, when the vibration membrane 260 moves downward (pump mode), the pressure in the vibration chamber 210 is higher than the pressure outside of the vibration chamber 210, enabling the fluid to flow out of the vibration chamber 210 via the fluid inlet 220 and the fluid outlet 230. It should be noted that when the actuator 270 reciprocates, a pair of fluid vortices F1' and a pair of fluid vortices F2' respectively exist at the chamber inlet 211 and the chamber outlet 212 of the vibration chamber 210. As described, by the disposition of the first flow guides 213 near the chamber inlet 211, the amount of fluid near the chamber inlet 211 flowing back to the fluid inlet 220 is reduced when the actuator 270 reciprocates. In another aspect, the second flow guides 214 effectively guide the pair of fluid vortices F2' to the chamber outlet 212, and the amount of the fluid flowing to the fluid outlet 230 is therefore increased. As described, when the first flow guide 213 and the second flow guide 214 both exist, the amount of fluid flowing toward the fluid inlet 220 can be further reduced, and the fluid is effectively guided toward the fluid outlet 230 in order to increase the positive net flow rate toward the fluid outlet 230 and achieve the operational function of the membrane micropump 200.

The inlet rectifier 240 connects the chamber inlet 211 with the chamber inlet 220, which is utilized to merge and buffer the fluid reciprocating between the fluid inlet 220 and the vibration chamber 210.

The outlet rectifier 250 connects the chamber outlet 212 with the fluid outlet 230, which is utilized to merge and buffer the fluid reciprocating between the vibration chamber 210 and the fluid outlet 230.

Figure 2D:
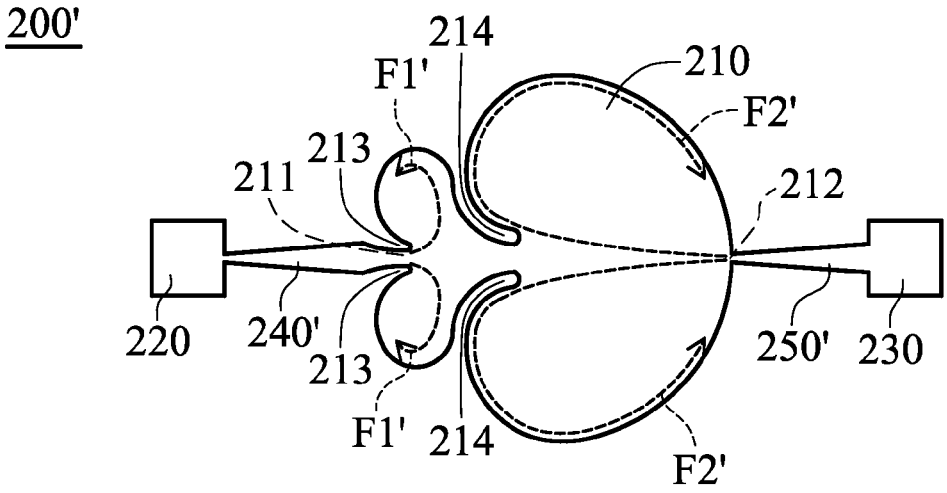
FIG. 2D is a schematic view of a variant embodiment of the membrane micropump in FIG. 2A.

As shown in FIG. 2D, the inlet rectifier and the outlet rectifier can change their geometric shapes to enable the flow resistance to becoming directionally-discrepant in order to increase the efficiency of the membrane micropump. In detail, in the membrane micropump 200' as shown in FIG. 2D, the inlet rectifier 240' comprises a shape which ascends from the fluid inlet 220 toward the chamber inlet 211, and the outlet rectifier 250' comprises a shape which ascends from the chamber outlet 212 toward the fluid outlet 230. When the vibration membrane 260 moves upward (supply mode), the flow resistance of the fluid from the inlet rectifier 240' toward the vibration chamber 210 is lower than the flow resistance of the fluid from the outlet rectifier 250' toward the vibration chamber 210. On the contrary, when the vibration membrane 260 moves downward (pump mode), the flow resistance of the fluid from the outlet rectifier 250' toward the vibration chamber 210 is lower the flow resistance of the fluid from the inlet rectifier 240' toward the vibration chamber 210. Therefore, the efficiency of the membrane micropump 200' is enhanced. Moreover, the inlet rectifier and the outlet rectifier of the embodiment can be applied to a Tesla valve or other means (a structure or a process) to obtain discrepant flow resistances, and for example a surface wettability modification may apply.

Third Embodiment

Figure 3A:
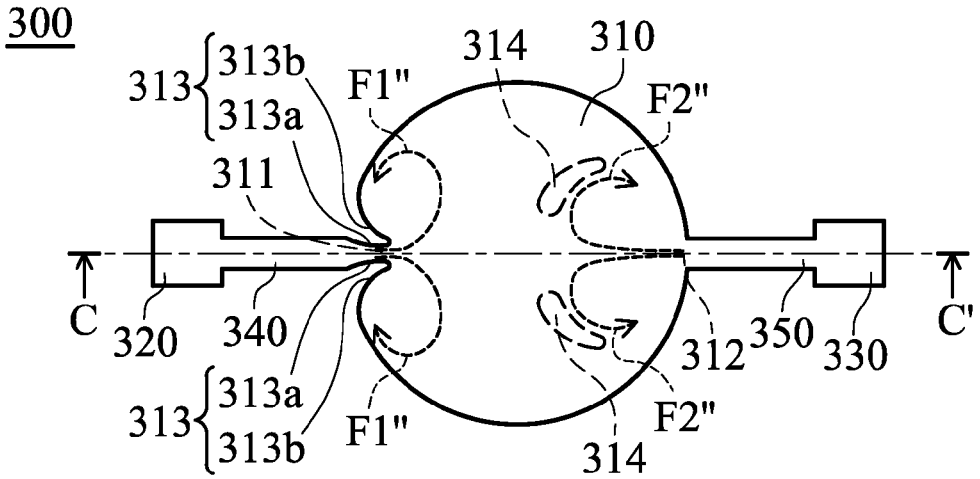
FIG. 3A is a top of a membrane micropump of a third embodiment of the invention.
Figure 3B:
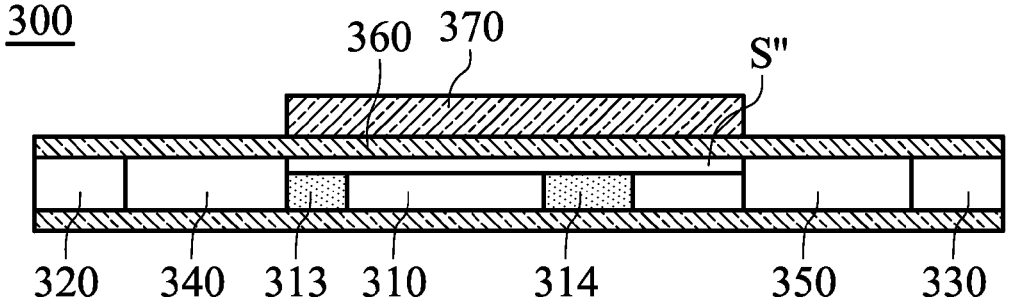
FIG. 3B is a sectional view cut along line C-C' in FIG. 3A.

Referring to FIGS. 3A and 3B, the membrane micropump 300 of the embodiment comprises a vibration chamber 310, two first flow guides 313, two second flow guides 314, a fluid inlet 320, a fluid outlet 330, an inlet rectifier 340, an outlet rectifier 350, a vibration membrane 360 and an actuator 370.

The vibration chamber 310 comprises a chamber inlet 311, a chamber outlet 312. The two flow guides 313 are symmetrically disposed at the chamber inlet 311 and located near the chamber inlet 311. The two second flow guides 314, corresponding to the chamber outlet 312, independent from the vibration chamber 310 and are disposed in the vibration chamber 310. In detail, each of the first flow guides 313 respectively comprises a inwardly-converging flange 313*a* and a curved structure 313*b*, thereby reducing the flow rate of the fluid from the vibration chamber 310 back to the chamber inlet 311. Each of the second flow guides 314 is streamlined to guide the fluid smoothly to the chamber outlet 312. Therefore, the operational function of the membrane micropump 300 is achieved.

It should be noted that in the embodiment, there are only two second flow guides, but it is not limited thereto. There can be more than four (two pairs) second flow guides to increase the efficiency of the membrane micropump. Moreover, the first flow guide can also be a different type, for example it can be disposed in the vibration chamber as an independent member.

The vibration membrane 360 is disposed above the vibration chamber 310. Here shown in FIG. 3B, a membrane movement space S" exists between the vibration membrane 360 and the vibration chamber 310.

As shown in FIGS. 3A and 3B, the actuator 370, connected with the vibration membrane 360, is utilized to reciprocate the vibration membrane 360. The actuator 370 comprises a piezoelectric member, an electromagnetic driver, a heat driver, a pneumatic membrane member, a mechanical vibrating member or a thermal-pneumatic driver. For example, when the actuator 370 is a piezoelectric member, the vibration membrane 360 is deformed by reciprocally expansion and contraction of the piezoelectric member, enabling the vibration membrane 360 to reciprocally vibrate.

As described, when the actuator 370 drives the vibration membrane 360 to reciprocally vibrate, the interior space or volume of the vibration chamber 310 increases or decreases accordingly. In detail, when the vibration membrane 360 moves upward (supply mode), the pressure in the vibration chamber 310 is lower than the pressure outside of the vibration chamber 310, enabling the fluid to flow from the fluid inlet 320 and the fluid outlet 330 to be sucked into the vibration chamber 310. On the contrary, when the vibration membrane 360 moves downward (pump mode), the pressure in the vibration chamber 310 is higher than the pressure outside of the vibration chamber 310, enabling the fluid to flow out of the vibration chamber 310 via the fluid inlet 320 and the fluid outlet 330. When the actuator 370 reciprocates, a pair of fluid vortices F1" and a pair of fluid vortices F2" respectively exist at the chamber inlet 311 and the chamber outlet 312 of the vibration chamber 310, as shown in FIG. 3A. As described, by the disposition of the flow guide 313 near the chamber inlet 311, the amount of the fluid near the chamber inlet 311 flowing back to the fluid inlet 320 is reduced when the actuator 370 reciprocates. In another aspect, the second flow guides 314 effectively guide the pair of fluid vortices F2" to the chamber outlet 312, and the amount of the fluid flowing to the fluid outlet 330 is therefore increased. As described, when the first flow guide 313 and the second flow guide 314 both exist, the amount of fluid toward the fluid inlet 320 can be further reduced, and the fluid is effectively guided toward the fluid outlet 330 in order to achieve the operational function of the membrane micropump 300.

The inlet rectifier 340 connects the chamber inlet 311 with the chamber inlet 320, which is utilized to merge and buffer the fluid reciprocating between the fluid inlet 320 and the vibration chamber 310.

The outlet rectifier 350 connects the chamber outlet 312 with the fluid outlet 330, which is utilized to merge and buffer the fluid reciprocating between the vibration chamber 310 and the fluid outlet 330.

Figure 3C:
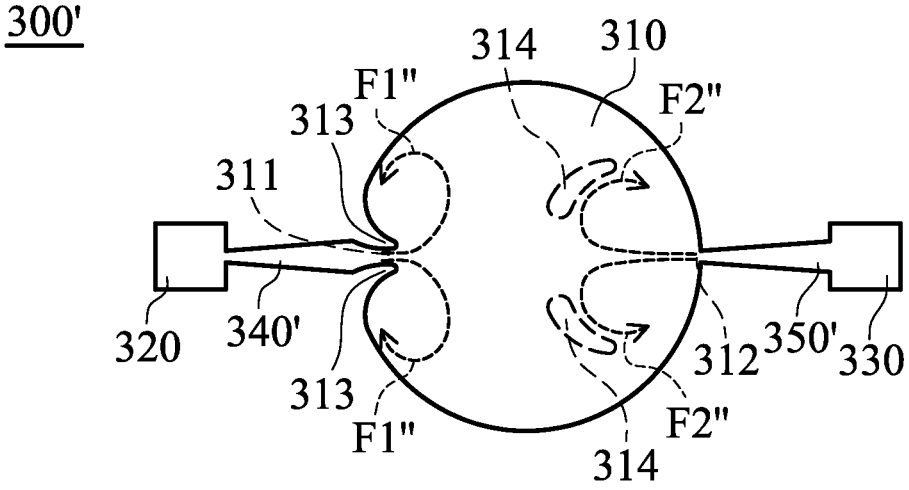
FIG. 3C is a schematic view of a variant embodiment of the membrane micropump in FIG. 3A.

As shown in FIG. 3C, the inlet rectifier and the outlet rectifier can change its geometric shape to enable the flow resistance to become directionally-discrepant in order to increase the efficiency of the membrane micropump. In detail, in the membrane micropump 300' as shown in FIG. 3C, the inlet rectifier 340' comprises a shape which ascends from the fluid inlet 320 toward the chamber inlet 311, and the outlet rectifier 350' comprises a shape which ascends from the chamber outlet 312 toward the fluid outlet 330. When the vibration membrane 360 moves upward (supply mode), the flow resistance of the fluid from the inlet rectifier 340' toward the vibration chamber 310 is lower than the flow resistance of the fluid from the outlet rectifier 350' toward the vibration chamber 310. On the contrary, when the vibration membrane 360 moves downward (pump mode), the flow resistance of the fluid from the outlet rectifier 350' toward the vibration chamber 310 is lower the flow resistance of the fluid from the inlet rectifier 340' toward the vibration chamber 310. Therefore, the efficiency of the membrane micropump 300' is enhanced. Moreover, the inlet rectifier and the outlet rectifier of the embodiment can be applied to a Tesla valve or other means (a structure or a process) to obtain discrepant flow resistances, and for example, a surface wettability modification may also apply.

Fourth Embodiment

Figure 4A:
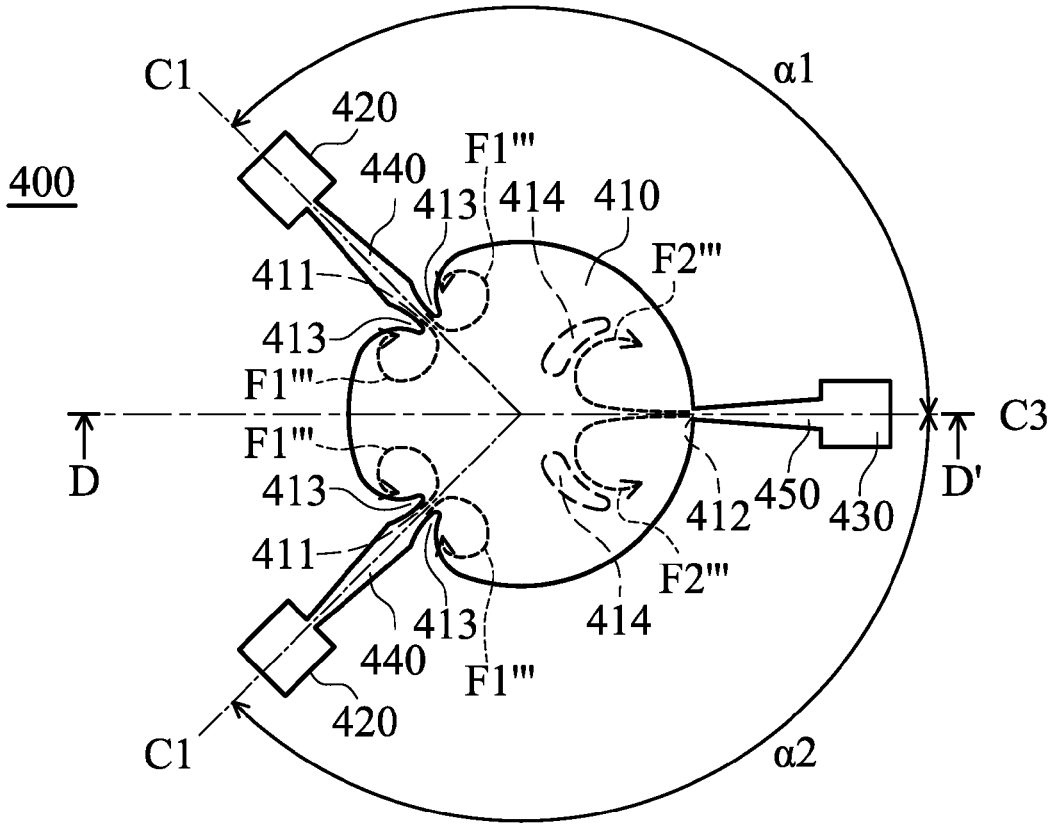
FIG. 4A is a top of a membrane micropump of a fourth embodiment of the invention.
Figure 4B:
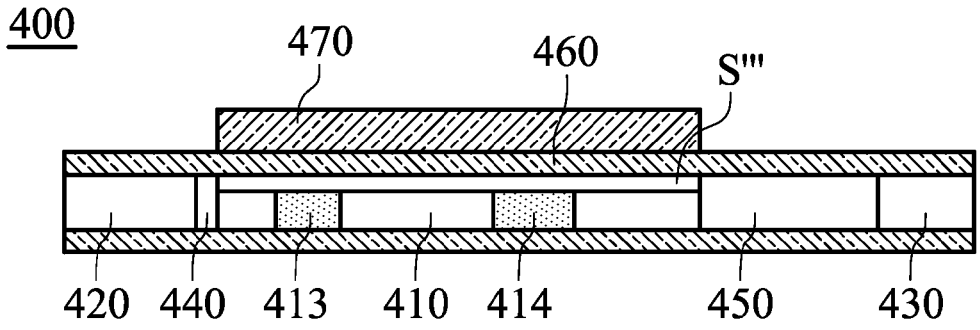
FIG. 4B is a sectional view cut along line D-D' in FIG. 4A.

Referring to FIGS. 4A and 4B, the membrane micropump 400 of the embodiment comprises a vibration chamber 410, four first flow guides 413, two second flow guides 414, two fluid inlets 420, a fluid outlet 430, two inlet rectifiers 440, an outlet rectifier 450, a vibration membrane 460 and an actuator 470.

The vibration chamber 410 comprises two chamber inlets 411 and a chamber outlet 412. The first flow guides 413 and the second flow guides 414 are actually the same structure as the first flow guides 313 and the second flow guides 314 in the third embodiment. Therefore, the related description thereof is omitted.

The vibration membrane 460 is disposed above the vibration chamber 410. Here shown in FIG. 4B, a membrane movement space S' exists between the vibration membrane 460 and the vibration chamber 410.

As shown in FIGS. 4A and 4B, the actuator 470 connected with the vibration membrane 460, reciprocates with the vibration membrane 460. The actuator 470 comprises a piezoelectric member, an electromagnetic driver, a heat driver, a pneumatic membrane member, a mechanical vibrating member or a thermal-pneumatic driver. For example, when the actuator 470 is a piezoelectric member, the vibration membrane 460 is deformed by reciprocally expansion and contraction of the piezoelectric member, enabling the vibration membrane 460 to reciprocally vibrate.

As described, when the actuator 470 drives the vibration membrane 460 to reciprocally vibrate, the interior space or volume of the vibration chamber 410 increases or decreases accordingly. In detail, when the vibration membrane 460 move upward (supply mode), the pressure in the vibration chamber 410 is lower than the pressure outside of the vibration chamber 410, enabling the fluid to flow from the fluid inlets 420 and the fluid outlet 430 to be sucked into the vibration chamber 410. On the contrary, when the vibration membrane 460 moves downward (pump mode), the pressure in the vibration chamber 410 is higher than the pressure outside f the vibration chamber 410, enabling the fluid to flow out of the vibration chamber 410 via the fluid inlets 420 and the fluid outlet 430.

As shown in FIG. 4A, it should be noted that two pairs of fluid vortices F1''' and a pair of fluid vortices F2''' respectively exist at the chamber inlets 411 and the chamber outlet 412 of the vibration chamber 410, which may be inspected via the flow visualization technology. As described, by the disposition of the second flow guide 414, the amount of the fluid near the chamber inlet 411 flowing back to the fluid inlet 420 is reduced when the actuator 470 reciprocates in order to provide a positive net flow rate toward the fluid outlet 430 and achieve the operational function of the membrane micropump 400. As described, the second flow guides 414 effectively guide the pair of fluid vortices F2''' to the chamber outlet 412 to provide a positive net flow rate toward the fluid outlet 430 in order to achieve the efficiency of the membrane micropump 400.

The inlet rectifier 440 connects the vibration chamber 410 with the fluid inlet 420, and the outlet rectifier 450 connects with the chamber outlet 412 and the fluid outlet 430.

Figure 5A:
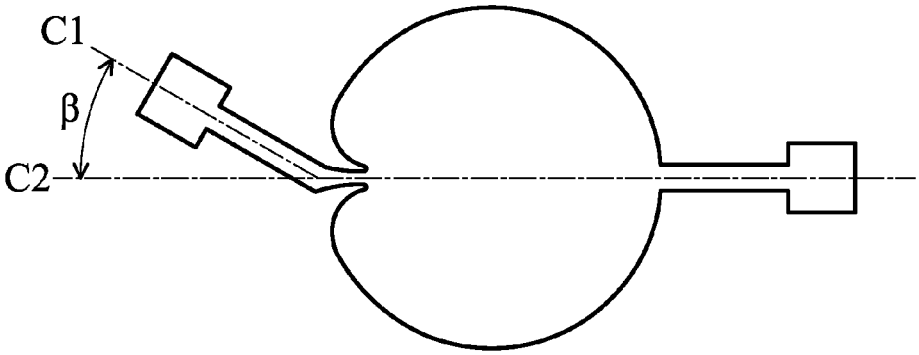
FIG. 5A is a schematic view of a variant embodiment of the membrane micropump.

It should be note that in the above described embodiments, an angle formed between a central line of the inlet rectifier and a normal line of a wall of the vibration chamber is 0°, but it is not limited thereto. The angle can be between ±90°. For example, referring to FIG. 5A, the angle β formed between the central line C1 of the inlet rectifier and the normal line C2 of the wall of the vibration chamber is substantially 30°.

Figure 5B:
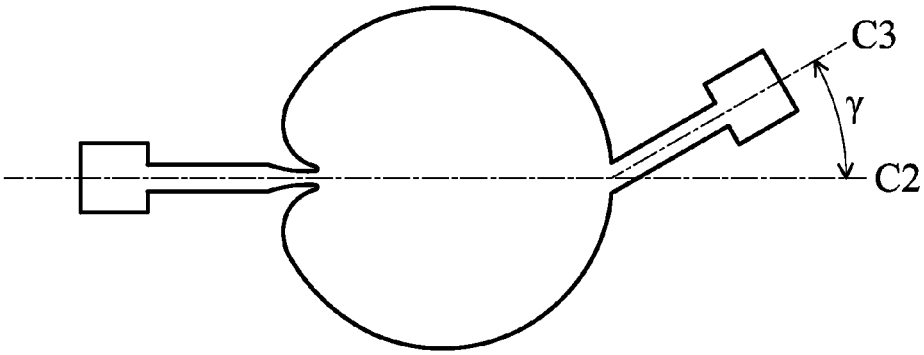
FIG. 5B is a schematic view of a variant embodiment of the membrane micropump.

Similarly, in the above embodiments, an angle formed between a central line of the outlet rectifier and a normal line of a wall of the vibration chamber is 0°, but it is not limited thereto. The angle can be between ±90°. For example, referring to FIG. 5B, the angle γ between the central line C3 of the outlet rectifier and the normal line C2 of the wall of the vibration chamber is substantially 30°.

Furthermore, in the first to the third embodiments, an angle formed between a central line of the inlet rectifier and a central line of the outlet rectifier is 180°, but it is not limited thereto. The angle can be between 0°~180°. For example, referring to FIG. 4A again, the angles α1-α2 between the central line C1 of the inlet rectifiers 440 and the central line C3 of the outlet rectifier 450 are substantially 135°. The two inlet rectifiers 440 are utilized to guide two of the same kinds or different kinds of fluids into the vibration chamber 410 to increase the flow rate of the fluid entering the vibration chamber 410 or to mix the fluids.

Additionally, multiple inlet rectifiers and multiple outlet rectifiers may apply, and the number of inlet rectifiers is different from the number of the outlet rectifiers. The angle between the central line of each of the inlet rectifiers and the central line of one of the outlet rectifiers can be different, or the angle between the central line of each of the outlet rectifiers and the central line of one of the inlet rectifiers can be different to increase the functionality of the membrane micropump. The rectifiers disposed between the multiple inlet rectifiers and the multiple outlet rectifiers may comprise different geometric shapes.

Referring to FIG. 4A again, the inlet rectifier 440 and the outlet rectifier 450 comprise unsymmetrical shapes to enable the flow resistance to become directionally-discrepant in order to increase the efficiency of the membrane micropump. In detail, the inlet rectifier 440 comprises a shape which ascends from the fluid inlet 420 toward the chamber inlet 411, and the outlet rectifier 450 comprises a shape which ascends from the chamber outlet 412 toward the fluid outlet 430. When the vibration membrane 460 moves upward (supply mode), the flow resistance of the fluid from the inlet rectifier 440 toward the vibration chamber 410 is lower than the flow resistance of the fluid from the outlet rectifier 450 toward the vibration chamber 410. On the contrary, when the vibration membrane 460 moves downward (pump mode), the flow resistance of the fluid from the outlet rectifier 450 toward the vibration chamber 410 is lower the flow resistance of the fluid from the inlet rectifier 440 toward the vibration chamber 410. Therefore, the efficiency of the membrane micropump 400 is enhanced. Moreover, the inlet rectifier 440 and the outlet rectifier 450 of the embodiment can be applied to a Tesla valve or other means (a structure or a process) to obtain discrepant flow resistances, and for example a surface wettability modification may also apply.

Fifth Embodiment

Figure 6A:
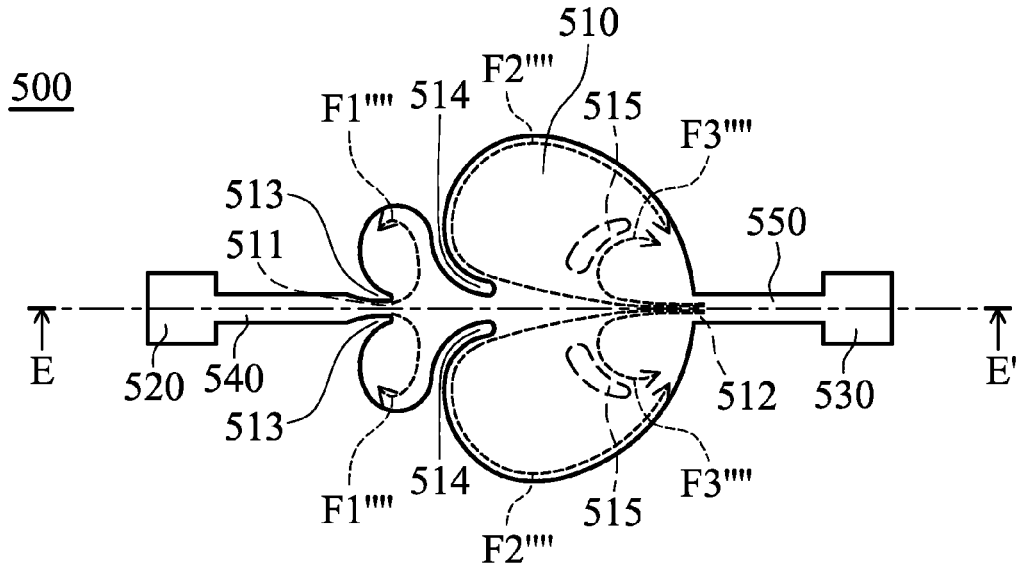
FIG. 6A is a top of a membrane micropump of a fifth embodiment of the invention.
Figure 6B:
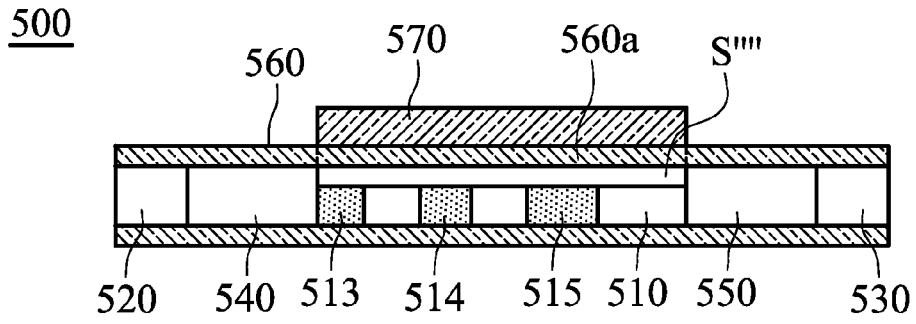
FIG. 6B is a sectional view cut along line E-E' in FIG. 6A.

Referring to FIGS. 6A and 6B, the membrane micropump 500 of the embodiment comprises a vibration chamber 510, two first flow guides 513, two second flow guides 514, two third flow guides 515, a fluid inlet 520, a fluid outlet 530, an inlet rectifier 540, an outlet rectifier 550, a vibration membrane 560 and an actuator 570.

The vibration chamber 510 comprises a chamber inlet 511 and a chamber outlet 512. The first flow guides 513 and the second flow guides 514 are actually the same structure as the first flow guides 213 and the second flow guides 214 in the second embodiment. The third flow guides 515 are actually the same structure as the second flow guides 314 in the third embodiment. Therefore, the related description thereof is omitted.

The vibration membrane 560 is disposed above the vibration chamber 510. Here shown in FIG. 6B, the vibration membrane 560 has a vibrating portion 560*a*, and a membrane movement space S"" exists between the vibrating portion 560*a* and the vibration chamber 510.

As shown in FIGS. 6A and 6B, the actuator 570 connected with the vibration membrane 560, reciprocates with the vibration membrane 560. The actuator 570 comprises a piezoelectric member, an electromagnetic driver, a heat driver, a pneumatic membrane member, a mechanical vibrating member or a thermal-pneumatic driver. For example, when the actuator 570 is a piezoelectric member, the vibrating portion 560*a* is deformed by reciprocally expansion and contraction of the piezoelectric member, enabling the vibrating portion 560*a* to reciprocally vibrate.

As described, when the actuator 570 drives the vibrating portion 560*a* to reciprocally vibrate, the interior space or volume of the vibration chamber 510 increases or decreases accordingly. In detail, when the vibrating portion 560*a* move upward (supply mode), the pressure in the vibration chamber 510 is lower than the pressure outside of the vibration chamber 510, enabling the fluid to flow from the fluid inlets 520 and the fluid outlet 530 to be sucked into the vibration chamber 510. On the contrary, when the vibrating portion 560*a* moves downward (pump mode), the pressure in the vibration chamber 510 is higher than the pressure outside of the vibration chamber 510, enabling the fluid to flow out of the vibration chamber 510 via the fluid inlets 520 and the fluid outlet 530. It should be noted that when the actuator 570 reciprocates, a pair of fluid vortices F1"" respectively exists at the chamber inlet 511 of the vibration chamber 510, a pair of fluid vortices F2"" exist between the second flow guide 514 and the third flow guide 515, and a pair of fluid vortices F3"" exists at the chamber outlet 512 of the vibration chamber 510 as shown in FIG. 6A. As described, by the disposition of the first flow guides 513 near the chamber inlet 511, the amount of fluid near the chamber inlet 511 flowing back to the fluid inlet 520 is reduced when the actuator 570 reciprocates. In another aspect, the second flow guides 514 and the third flow guides 515 effectively guide the pair of fluid vortices F2"" and the pair of the fluid vortices F3"" to the chamber outlet 512, and the amount of the fluid flowing to the fluid outlet 530 is therefore increased. As described, when the first flow guides 513, the second flow guides 514 and the third flow guides 515 all exist, the amount of fluid flowing toward the fluid inlet 520 can be further reduced, and the fluid is effectively guided toward the fluid outlet 530 to increase a positive net flow rate toward the fluid outlet 530 in order to achieve the operational function of the membrane micropump 500.

The inlet rectifier 540 connects the chamber inlet 511 with the fluid inlet 520, which is utilized to merge and buffer the fluid reciprocating between the fluid inlet 520 and the vibration chamber 510.

The outlet rectifier 550 connects the chamber outlet 512 with the fluid outlet 530, which is utilized to merge and buffer the fluid reciprocating between the vibration chamber 510 and the fluid outlet 530.

Figure 6C:
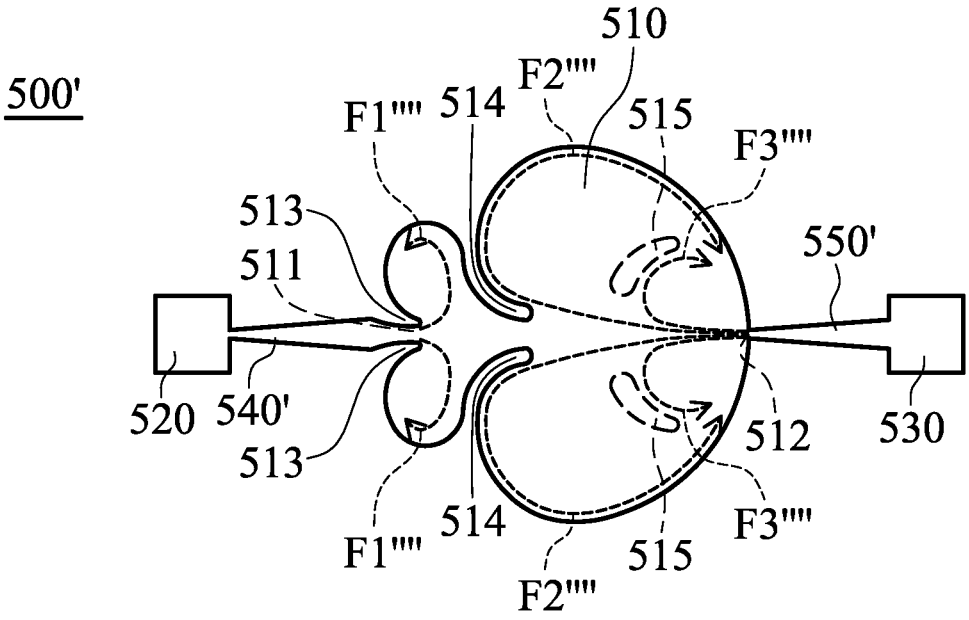
FIG. 6C is a schematic view of a variant embodiment of the membrane micropump in FIG. 6A.

As shown in FIG. 6C, the inlet rectifier and the outlet rectifier can change its geometric shapes to enable the flow resistance to become directionally-discrepant in order to increase the efficiency of the membrane micropump. In detail, in the membrane micropump 500' as shown in FIG. 6C, the inlet rectifier 540' comprises a shape which ascends from the fluid inlet 520 toward the chamber inlet 511, and the outlet rectifier 550' comprises a shape which ascends from the chamber outlet 512 toward the fluid outlet 530. When the vibration membrane 560 moves upward (supply mode), the flow resistance of the fluid from the inlet rectifier 540' toward the vibration chamber 510 is lower than the flow resistance of the fluid from the outlet rectifier 550' toward the vibration chamber 510. On the contrary, when the vibration membrane 560 moves downward (pump mode), the flow resistance of the fluid from the outlet rectifier 550' toward the vibration chamber 510 is lower than the flow resistance of the fluid from the inlet rectifier 540' toward the vibration chamber 510. Therefore, the efficiency of the membrane micropump 500' is enhanced. Moreover, the inlet rectifier and the outlet rectifier of the embodiment can be applied for a Tesla valve or other means (a structure or a process) to obtain directionally-discrepant flow resistances, and for example a surface wettability modification may apply.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A valveless membrane micropump, comprising:

a substrate;

a vibration membrane disposed corresponding to the substrate and having a vibrating portion;

a vibration chamber, formed between the vibrating portion and the substrate, comprising at least one chamber inlet and at least one chamber outlet;

at least one flow guide, situated between the vibrating portion and the substrate, extending in a direction perpendicular to the substrate and adjacent to the vibration chamber, guiding a fluid within the vibration chamber to flow in order to provide a positive net flow rate toward the at least one chamber outlet;

at least one fluid inlet;

at least one fluid outlet;

at least one inlet rectifier connecting the at least one chamber inlet to the at least one fluid inlet;

at least one outlet rectifier connecting the at least one chamber outlet to the at least one fluid outlet; and an actuator connected to the vibration membrane to reciprocate the vibrating portion, enabling the fluid to flow into the vibration chamber via the at least one fluid inlet and flow out of the vibration chamber via the at least one fluid outlet, wherein when viewed in a direction of oscillation perpendicular to a plane of the vibration membrane, the actuator extends over and overlaps the vibration chamber and the at least one flow guide.

2. The valveless membrane micropump as claimed in claim 1, wherein the at least one flow guide comprises an inwardly-converging flange and a curved structure, the inwardly-converging flange connects with the at least one chamber inlet, and the curved structure connects with the inwardly-converging flange to reduce flow rate of the fluid toward the at least one fluid inlet in order to provide a positive net flow rate toward the at least one fluid outlet.

3. The valveless membrane micropump as claimed in claim 1, wherein the at least one flow guide, forming a bean-shaped structure, is disposed in the vibration chamber to reduce flow rate of the fluid toward the at least one chamber inlet or to increase the flow rate of the fluid toward the at least one fluid outlet in order to provide a positive net flow rate toward the at least one fluid outlet.

4. The valveless membrane micropump as claimed in claim 1, wherein the at least one flow guide, connecting with the vibration chamber, comprises two curved structures to reduce flow rate of the fluid toward the at least one chamber inlet or to increase flow rate of the fluid toward the at least one fluid outlet in order to provide a positive net flow rate toward the at least one fluid outlet.

5. The valveless membrane micropump as claimed in claim 1, wherein the actuator comprises a piezoelectric member, a electromagnetic driver, a heat driver, a pneumatic membrane member, a mechanical vibrating member or a thermal-pneumatic driver.

6. The valveless membrane micropump as claimed in claim 1, wherein the at least one inlet rectifier's flow resistance and the at least one outlet rectifier's flow resistance are directionally-discrepant to enhance the flow directionality of the membrane micropump and to increase efficiency of the membrane micropump.

7. The valveless membrane micropump as claimed in claim 1, wherein an angle formed between a central line of the at least one inlet rectifier and a central line of the at least one outlet rectifier is between 0°~180°.

8. The valveless membrane micropump as claimed in claim 1, wherein an angle formed between a central line of the at least one inlet rectifier and a normal line of a wall of the vibration chamber is between ±90°, or an angle formed between a central line of the at least one outlet rectifier and a normal line of a wall of the vibration chamber is between ±90°.

9. The valveless membrane micropump as claimed in claim 1, wherein the number of the at least one inlet rectifier is different than the number of the at least one outlet rectifier.

10. A valveless membrane micropump, comprising:

a substrate;

a vibration membrane disposed corresponding to the substrate and having a vibrating portion;

a vibration chamber, formed between the vibrating portion and the substrate, comprising at least one chamber inlet and at least one chamber outlet;

at least one first flow guide, situated between the vibrating portion and the substrate, extending in a direction perpendicular to the substrate and adjacent to the vibration chamber;

at least one second flow guide, situated between the vibrating portion and the substrate, extending in a direction perpendicular to the substrate and adjacent to the vibration chamber, wherein the at least one first flow guide and the at least one second flow guide simultaneously guide a fluid within the vibration chamber to flow in order to provide a positive net flow rate toward the at least one chamber outlet;

at least one fluid inlet;

at least one fluid outlet;

at least one inlet rectifier connecting the at least one chamber inlet to the at least one fluid inlet;

at least one outlet rectifier connecting the at least one chamber outlet to the at least one fluid outlet; and an actuator connected to the vibration membrane to reciprocate the vibrating portion, enabling the fluid to flow into the vibration chamber via the at least one fluid inlet and flow out the vibration chamber via the at least one fluid outlet, wherein when viewed in a direction of oscillation perpendicular to a plane of the vibration membrane, the vibrating portion actuator extends over and overlaps the vibration chamber, the at least one first flow guide, and the at least one second flow guide.

11. The valveless membrane micropump as claimed in claim 10, wherein the at least one first flow guide or the at least one second flow guide comprises an inwardly-converging flange and a curved structure, the inwardly-converging flange connects with the at least one chamber inlet, and the curved structure connects with the inwardly-converging flange to reduce the flow rate of the fluid toward the at least one fluid inlet in order to provide a positive net flow rate toward the at least one fluid outlet.

12. The valveless membrane micropump as claimed in claim 10, wherein the at least one first flow guide or the at least one second flow guide, connecting with the vibration chamber, comprises two curved structures to reduce flow rate of the fluid toward the at least one chamber inlet or to increase the flow rate of the fluid toward the at least one fluid outlet in order to provide a positive net flow rate toward the at least one fluid outlet.

13. The valveless membrane micropump as claimed in claim 10, further comprising:

at least one third flow guide forming a bean-shaped structure and disposed in the vibration chamber to reduce flow rate of the fluid toward the at least one chamber inlet or to increase the flow rate of the fluid toward the at least one fluid outlet in order to provide a positive net flow rate toward the at least one fluid outlet, wherein when viewed in the direction of oscillation, the actuator overlaps the at least one third flow guide.

14. The valveless membrane micropump as claimed in claim 10, wherein the actuator comprises a piezoelectric member, a electromagnetic driver, a heat driver, a pneumatic membrane member, a mechanical vibrating member or a thermal-pneumatic driver.

15. The valveless membrane micropump as claimed in claim 10, wherein the at least one inlet rectifier's flow resistance and the at least one outlet rectifier's flow resistance are directionally-discrepant to enhance the flow directionality of the membrane micropump and to increase efficiency of the membrane micropump.

16. The valveless membrane micropump as claimed in claim 10, wherein the number of the at least one inlet rectifiers is different than the number of the at least one outlet rectifier.

17. The valveless membrane micropump as claimed in claim 10, wherein an angle formed between a central line of the at least one inlet rectifier and a central line of the at least one outlet rectifier is between 0°~180°.

18. The valveless membrane micropump as claimed in claim 10, wherein an angle formed between a central line of the at least one inlet rectifier and a normal line of a wall of the vibration chamber is between ±90°, or an angle formed between a central line of the at least one outlet rectifier and a normal line of a wall of the vibration chamber is between ±90°.

* * * * *